United States Patent [19]

Ranzen

[11] Patent Number: 5,071,615

[45] Date of Patent: Dec. 10, 1991

[54] METHOD AND APPARTUS FOR MANUFACTURING FIBER SLABS

[75] Inventor: Carl O. Ranzen, Solna, Sweden

[73] Assignee: Sven Fredriksson, Sweden

[21] Appl. No.: 603,681

[22] PCT Filed: May 18, 1989

[86] PCT No.: PCT/SE89/00276

§ 371 Date: Nov. 1, 1990

§ 102(e) Date: Nov. 1, 1990

[87] PCT Pub. No.: WO89/11385

PCT Pub. Date: Nov. 30, 1989

[30] Foreign Application Priority Data

May 19, 1988 [SE] Sweden ..... 8801877

[51] Int. Cl.[5] ..... B27N 3/12; B27N 3/04

[52] U.S. Cl. ..... 264/510; 264/518; 264/112; 264/121; 425/81.1; 425/83.1

[58] Field of Search ..... 264/510, 511, 517, 518, 264/121, 112; 425/80.1, 81.1, 82.1, 83.1; 156/62.2, 62.6, 62.8

[56] References Cited

U.S. PATENT DOCUMENTS

| | | | |
|---|---|---|---|
| 1,931,570 | 10/1933 | Brown et al. | 264/121 |
| 2,571,334 | 10/1951 | Browne et al. | 264/518 |
| 2,715,755 | 8/1955 | Jones | 264/518 |
| 2,975,470 | 3/1961 | Snelson et al. | 425/83.1 |
| 3,147,165 | 9/1964 | Slayter | 264/112 |
| 3,341,890 | 9/1967 | Oja | 264/121 |
| 3,658,626 | 4/1972 | Berger et al. | 156/62.2 |
| 3,882,211 | 5/1975 | Kamp | 264/518 |
| 4,166,090 | 8/1979 | Green et al. | 264/518 |
| 4,257,754 | 3/1981 | Green et al. | 425/84 |
| 4,401,610 | 8/1983 | Ohberg | 264/40.4 |

FOREIGN PATENT DOCUMENTS

| | | | |
|---|---|---|---|
| 818906 | 4/1981 | U.S.S.R. | 425/83.1 |

*Primary Examiner*—Mary Lynn Theisen

*Attorney, Agent, or Firm*—Kinzer, Plyer, Dorn, McEachran & Jambor

[57] ABSTRACT

The present invention relates to a method and an apparatus for manufacturing a fiber slab (32), in which a fiber/air suspension is blown through a nozzle into a forming space (9). The forming space is defined by two mutually facing belt parts of two endless belts (10, 11). For the purpose of manufacturing the novel fiber slab, there is generated between the nozzle exit orifice (8') and the forming chamber a mist of highly liquid adhesive, and the fibers are imparted kinetic energy of such high value that the fibers pass essentially rectilinearly through the mist and into the forming chamber, where they collect on the slab end surface (36) earlier formed in the forming chamber and facing the nozzle.

10 Claims, 2 Drawing Sheets

METHOD AND APPARTUS FOR MANUFACTURING FIBER SLABS

Figure 1:
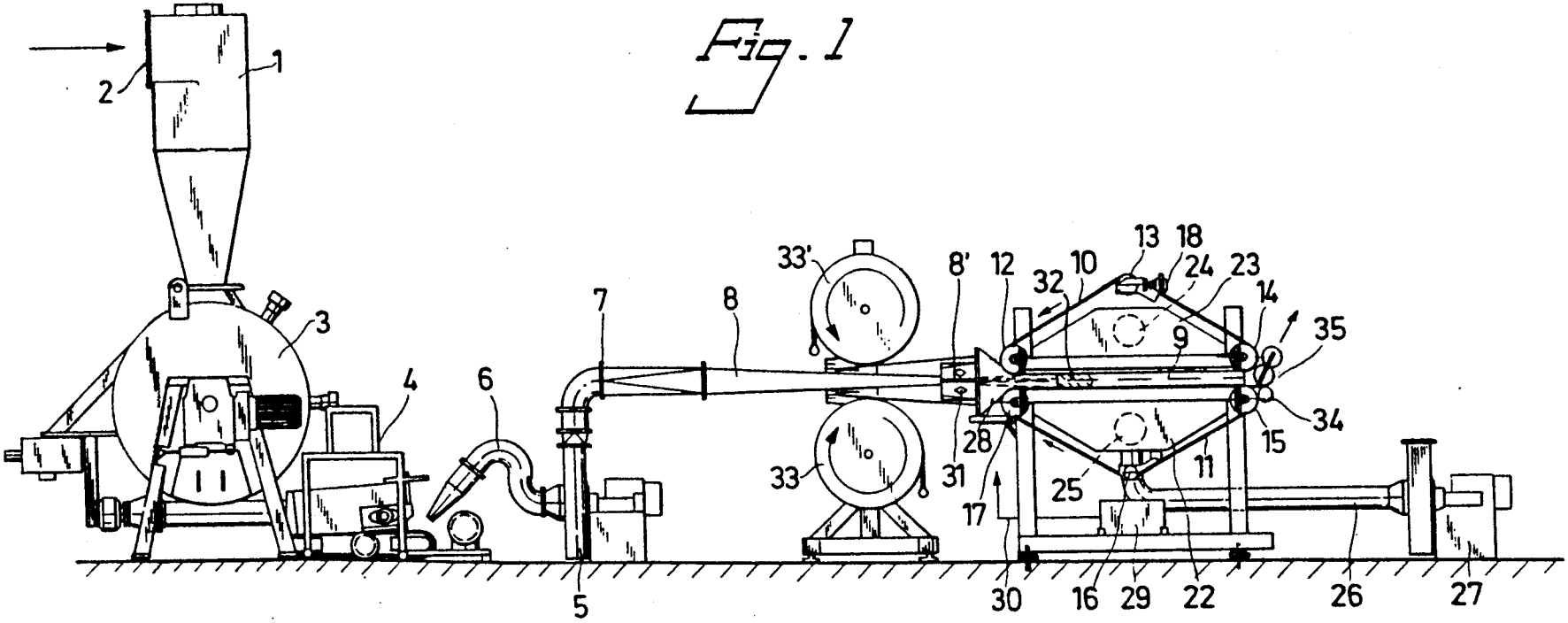

The invention relates to a method of manufacturing a fiber slab, in which method a fiber/air suspension is blown through a nozzle into a forming chamber which is defined by two mutually opposing belt parts of two endless, air-permeable driven belts, said belt parts being moved in mutually the same direction, and further defined by two mutually facing, substantially impervious side walls, the mutually distal surfaces of said two band parts co-acting with a suction source. The invention also relates to apparatus for carrying out the method.

Slabs or mats, bats, produced in accordance with the aforedescribed technique have been found to have highly satisfactory heat and sound insulating properties, but lack the requisite stability for use, for instance, as building slabs, since it is then necessary to increase the density of the slab to a level higher than that required for sound absorption and heat insulation purposes, in order to prevent the fibrous material from collapsing and therewith loosing the open structure of the loosely knit fiber body formed when injecting the fibers into said forming chamber.

Accordingly, a prime object of the present invention is to provide with the aid of so-called dry forming processes on the basis of the known technique a fiber slab or fiber bat in which the fibers form an open structure or matrix where the fibers, to a substantial extent, are bound together and form a stable but non-compacted structure.

This object is realized by the novel method, mainly by creating a mist of highly liquid, or thin-bodied adhesive in the region between the nozzle exit orifice and the forming chamber, and by, imparting to the fibers kinetic energy of such high value that the fibers will pass substantially rectilinearly through the mist and into the forming chamber and collected in said chamber on a slab end surface previously formed in the forming chamber and facing said nozzle.

The main purpose of the aforesaid suction source is to remove the air injected and not to appreciably influence the fibers, which are thus able to move towards said slab end surface and collect thereon. The continued formation of the slab or bat can be regulated by controlling the kinetic energy imparted to the fibers and also by controlling the velocity of the belts, so that the slab will be built-up progressively from said end surface and such as to form an open, air-enclosing matrix or structure. The individual fibers in this matrix or structure will be bonded together in punctiform fashion, and because the adhesive or binder used is highly liquid, the adhesive will be sucked towards the points of contact between the individual fibers, through capillary forces, and therewith bind the fibers into a stable fiber matrix, in which those parts of the fibers located between the contact points will be essentially free from surplus adhesive. As opposed to the case when fibers are impregnated with adhesive, the free parts of the fibers will thus at most be coated with a highly superficial coating of adhesive and consequently the flexibility of the fibers will not be reduced to any appreciable extent, while retaining the ability of the fibers to dampen accustic energy will remain substantially unchanged.

The invention also enables a fireproof, or at least flame-proof, slab to be produced, even when the fibers used are cellulose fibers. In this instance the binder used is a known binder in this context, such as an alkali silicate adhesive.

A slab manufactured in accordance with the novel method can be given a relatively low density, e.g. a density of 30–50 kg/m$^3$, without impairing the sound absorption properties of the slab. The slab can, at the same time, be made flame-proof.

The main characteristic features of the inventive apparatus are set forth in the following apparatus claims.

Figure 2:
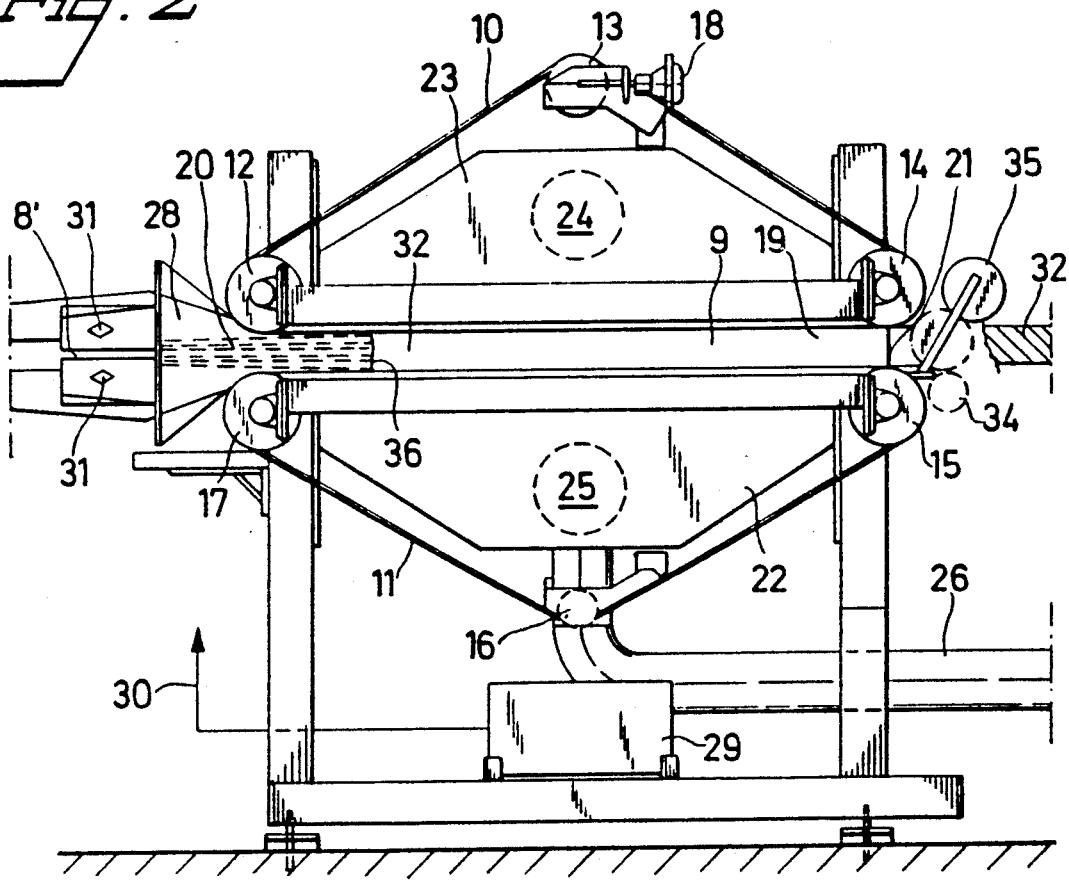
Figure 3:
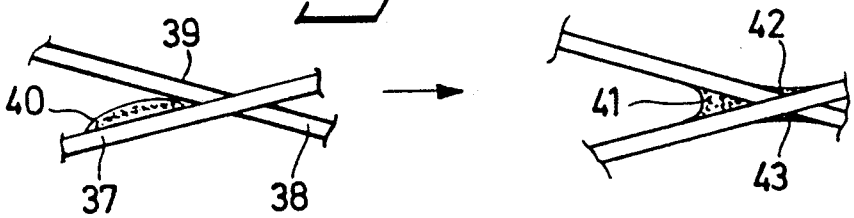

The invention will now be described in more detail with reference to the accompanying drawings, in which FIG. 1 illustrates plant machinery chosen by way of example;

FIG. 2 illustrates in larger scale the forming chamber and the blow section of the plant co-acting with the chamber; and FIG. 3 illustrates the capillary effect utilized to form the stable, open structure or fiber matrix.

FIG. 1 is a simplified illustration of plant machinery according to the invention. It is assumed in the following description that the inventive slabs are formed from a cellulose fiber starting material, fluff, this material optionally being formed into continuous lengths which are subsequently cut, e.g. sawn, into slabs of desired lengths. It will also be understood, however, that the cellulose fiber may be mixed, for instance, with mineral-wool fiber, synthetic plastic fibers, for instance, polypropylene fibers, or replaced completely with such fibers. With reference to FIG. 1, in the manufacture of continuous webs or bats, cellulose fibers (fluff) are fed into a cyclone 1, through an infeed opening 2, and introduced into a mixer 3, where the fibers are mixed with air. The fiber/air mixture or suspension is passed from the mixer 3 to a portioning or metering unit 4, which dispenses said suspension in given quantities per unit of time, with the aid of a feed screw not shown. The metered quantities of fiber mass are drawn by suction into a conduit 6 connected to the inlet side of a fan 5 and are transported in the form a fiber suspension through a further conduit 7 to an elongated, tapering accelerating nozzle 8. During their passage along the nozzle 8, the individual fibers of the suspension are imparted kinetic energy of such high value that when leaving the nozzle 8, the fibers will move substantially rectilinearly into a forming chamber 9. The top and bottom surface of the forming chamber 9 are defined by two substantially, mutually parallel air-permeable, endless belts 10 and 11. The belts 10 and 11 run over rollers 12, 13, 14, 15, 16 and 17, of which at least the rollers 13 and 16 are driven by, for instance, the motor 18 which drives the belt 10. The belts 10 and 11 are driven at mutually the same speed and in the direction shown by the arrows. The forming chamber 9, whose top and bottom surfaces are defined by the aforesaid two belts 10 and 11, is defined in its vertical extension by air-impermeable walls, of which the rear wall 19 is marked in FIG. 2. Thus, the forming chamber 9 has a width which corresponds to the width of the air permeable belts 10 and 11 and a vertical extension, or height, which corresponds to the vertical spacing between the mutually opposing parts of the belts 10 and 11. The outlet 21 from the forming chamber 9 (see FIG. 2) is completely open to the exit orifice of the nozzle 8, which orifice will preferably have a width which corresponds to or is slightly smaller than the width of the forming chamber 9, whereas the outlet 21, on the other hand, can be closed by means of a closing roller 35, which is preferably made of lightweight material, for instance a foamed plastic material. The roller 35 can be raised so as to expose the outlet opening 21, as will be described hereinafter. For the purpose of guiding the fibers suspension exiting from the nozzle orifice 8', a blow chamber 28 is provided upstream of and in connection with the forming chamber inlet 20. The blow chamber 28 may be configured to form, together with the blow nozzle 8, an injector such that ambient air will be drawn by suction into the gap defined between the impervious, outer walls of the orifice of the funnel-shaped nozzle, and the two rollers 12 and 17, therewith optionally engendering an overpressure in the blow container. Suction boxes 22 and 23 are arranged along the whole length of the forming chamber 9, such as to generate an underpressure in said forming chamber. The two suction boxes 22, 23 are connected to a suction fan 27, or some other suitable suction source, via the opening 24, 25 and a pipe 26. The plant machinery illustrated in FIG. 1 includes an adhesive container 29, provided with a pump (not shown), for feeding a highly liquid, polymeric silicate binder through a pipe 30 to a spray mozzle 31, which is intended to form in the blow container an adhesive mist which settles on the fibers moving therethrough. The formed slab or web 32 is moved out of the forming chamber 9 by the belts 10 and 11, and is transferred onto a conveyor, for instance a roller conveyor. One such roller conveyor is indicated by a roller 34. Depending on whether the slab 32 shall be subjected to heat treatment, pressing, cutting or some other working process, the slab is transported to a drying chamber, a press means or a cutter. When the slab discharged from the forming chamber already has the intended length, which can be achieved by intermittent feeding of fibers to the mixer 3, each slab thus produced may be used immediately, provided that a quickdrying adhesive is used and provided that it is not necessary to trim the end surfaces of the slab. In the case of the illustrated, exemplifying embodiment the slabs produced are provided on the outer surface with a layer, for instance, of tissue having a surface weight, or grammage, of 18 $g/m^3$ or therebelow, or a non-woven fabric, this material being drawn in lengths from two storage reels 33 and 33' and applied to the mutually facing surfaces of the air permeable belts 10 and 11. The provision of such layers is not absolutely necessary, however, and when a quick-drying adhesive is used, e.g. a silicate adhesive, the fibers may come into direct contact with the two belts 10, 11, since any adhesive which might settle on belts 10, 11 will dry and be removed from the belt surfaces during passage of the belts over the rollers 12, 13, 14 and 15, 16, 17.

The modus operandi of the illustrated plant machinery will now be described with reference to FIGS. 2 and 3. The fibers used are cellulose fibers and it is assumed that the slab produced will be ready for use and that the slab will be flame-proof, in addition to effectively damping sound. In order to be able to produce a ready-for-use slab, e.g. a slab which requires no heat treatment, it is necessary to use an adhesive which will dry rapidly at room temperature, while the desired sound damping properties of the slab require the cellulose fibers to be practically non-impregnated and to retain their mobility. A flame-proof slab can be obtained by using, for instance, a pre-polymerized alkali silicate of the kind sold commercially under the trade name Bindzil FK10. This binder is diluted with up to 100 percent by weight water. A binder which will dry quickly at room temperature and which is completely dry when the slab leaves the forming chamber 9 is a requirement in achieving a sound dampening ability which exceeds the sound dampening ability of a conventional glass fiber bat or mineral wool bat of the same density, meaning that the adhesive shall not be allowed to penetrate into the cavities of the cellulose fibers and render the fibers rigid subsequent to drying of the adhesive.

As described in the aforegoing, the fibers leave the outlet orifices 8' of the accelerater nozzle and the velocity of the exiting air stream and the kinetic energy of each individual fiber is such that the fibers will move rectilinearly, or at least substantially rectilinearly, into and out of the blow chamber 28. A mist of readily blowable and quick-drying silicate adhesive is generated in the blow chamber, by means of the nozzles 31, which may be directed transversely to or in the direction of the fiber flow. A thin layer of adhesive is applied to at least the major part of the fibers in the fiber flow, and the fibers will flow rapidly into the forming chamber, up to the location of the stop roller 35, against which a fiber slab wall 36 is build-up. This fiber slab wall 36 is moved rapidly against the fiber flow, and the belts 10 and 11 are set into motion when the fiber slab wall 36 is located, for instance, in the position shown in FIG. 2, the speed of said belts 10 and 11 being adjustable. When the slab formed between the fiber plate wall 36 and the stop roller is moved to the right in FIG. 2, upon starting up the belts 10, 11, the roller 35 will be displaced obliquely upwards/forwards to the position shown in full lines, therewith exposing the outlet 21 of the forming chamber 9. The speed of the belts 10 and 11 is adjusted to correspond to the amount of fiber material supplied and the increased density of the slab, meaning that the fiber slab wall 36 will be substantially stationary. The adhesive-moistened fibers move in the direction of the longitudinal axis of the forming chamber 9 and are essentially uniformly distributed by the nozzle 8 over the upstanding wall or end surface of the plate 32 extending perpendicularly to the movement direction of the fibers. The two suction boxes 23 and 24 have the essential purpose of removing from the rearward part of the forming chamber 9, as seen in the direction of movement, air which has been injected into the chamber and against the wall 36, thereby to prevent the occurrence of a turbulent state, which would otherwise prevent the fibers from passing essentially at right angles to the wall or the end surface 36 and, instead, pass onto the belts 10 and 11 or, in the present case, onto the air permeable tissue webs. In the case of the illustrated embodiment, a suction effect also prevails behind the end surface 36, which contributes to withdrawing by suction a large amount of the thin-bodied silicate layer on the coated fibers. This removal by suction of the adhesive results in impregnation of the tissue webs such as to provide a practically fireproof slab, when using a silicate adhesive of the aforesaid kind, while the fibers located inwardly of the silicate-drenched tissue layers will obtain the desired sound damping properties and remain flame-proof or essentially flame-proof.

FIG. 3 is a simplified view of two fibers 37, 38, which have been "displaced" against the end surface 36. The fiber 38 has been coated over the whole of its surface with a layer 39 of highly liquid silicate adhesive, whereas adhesive 40 has been applied to a smaller surface area of the fiber 37. It is well known that two mutually intersecting fibers will be bound together by capillary forces, owing to the absorption of the adhesive at the point of intersection, as illustrated to the right in FIG. 3, therewith forming bonding droplets 41, 42, 43, whereas the remaining parts of the fiber will at most be coated with a very thin adhesive layer. Thus, the fibers present in the finished slab will be bonded to one another in a manner to form a matrix in which the fibers cannot be displaced and which, in turn, means that when the slab is mounted vertically, for instance, the density of the slab will not change in the manner that a conventional, mineral-wool slab or a glass-wool slab would change, i.e. the fibers in the slab will not "avalanche" such as to result in a region of high density within the lower part of the slab and a region of lower density within the upper part of said slab. A slab produced in the aforedescribed manner, i.e. with mutually bonded fiber intersection points, and only a very thin coating on the fiber surfaces located externally of the intersection points, will have, in addition to flame resistance, an acoustic damping property which is higher than the acoustic damping property of, for instance, a mineral-wool slab of the same density and thickness. This improved sound absorption is due to the fact that the cellulose fiber cavities do not absorb the quickly-drying adhesive and thus retain their elasticity and, since the adhesive layer which at least substantially covers the fibers does not alter to any appreciable extent the mobility of each individual fiber between its fixed intersection points, the acoustic energy will be readily converted to kinetic energy and therewith engender oscillations in the fibers in the three-dimensional matrix consisting of fibers which are mutually bonded in a punctiform fashion. The density of a slab produced in accordance with the invention may be caused to vary in different ways, for example by changing the amount of fiber present in the fiber suspension and by modifying the kinetic energy of each separate fiber.

When the manufactured slab is to be subsequently pressed, it is necessary to use an adhesive which will dry relatively slowly, so that the slab can be pressed to the desired thickness or density while the adhesive is still soft, although it is still necessary in this case to use a highly liquid adhesive so as to be able to utilize the capillary forces and to produce binding droplets at the fiber intersection points, and to ensure that the fibers will be bonded in a punctiform fashion to form a stable, fiber matrix which, to the greatest causes the fiber mass to collapse. When the need for a flame-resistant slab no longer prevails and consequently, other types of binder than prepolymerized alkali silicates can be used, suitable binders are, for instance, polypropylene adhesives. As mentioned, the fiber material may also consist of synthetic fibers or a mixture of cellulose fibers and synthetic fibers. The amount of adhesive required to form the adhesive mist is controlled by changing the pump pressure.

I claim:

1. A method for manufacturing a fiber slab (32), in which a fiber/air suspension is blown through a nozzle (8) into a forming chamber (9), which forming chamber (9) is defined by two mutually opposing belt parts of two endless, air-permeable and driven belts (10, 11), said belt parts being moved in mutually the same direction, and further defined by two mutually facing and substantially impervious side walls (19), the mutually distal surfaces of said two belt parts co-acting with a suction source (27), forming a mist of highly liquid adhesive in the region between the exit orifice (8') of the nozzle (8) and the forming chamber (9); and by imparting to the fibers kinetic energy of such high value that said fibers will pass substantially rectilinearly through the mist and into the forming chamber and thereby collect into a slab.

2. A method according to claim 1 in which said adhesive is a polymeric silicate adhesive which dries at room temperature.

3. A method according to claim 1 in which the adhesive used is a slowly drying adhesive.

4. A method according to claim 1, in which the fibers are cellulose fibers and/or synthetic fibers.

5. A method according to claim 2, in which the fibers are cellulose fibers and/or synthetic fibers.

6. A method according to claim 3, in which the fibers are cellulose fibers and/or synthetic fibers.

7. Apparatus for manufacturing a fiber slab (32), in which a fiber/air suspension is blown through a nozzle (8) into a forming chamber (9) which is defined by two mutually facing belt parts of two endless, air permeable belts (10, 11), driven by drive means (12, 13, 14, 15, 16, 17, 18), and is further defined by two essentially impervious side walls (19) connecting with the two belt parts, and in which a suction source (27) is connected to suction means (22, 23) which co-act with the two air-permeable belt parts in a manner to withdraw air by suction from the forming chamber (9), in which there is provided between the exit orifice (8') of the nozzle (8) and the inlet (20) to the forming chamber (9) a blow chamber (28) having a plurality of adhesive nozzles (31) to which a highly liquid adhesive is supplied under pressure from a pump means (29) and intended to form an adhesive mist in the blow chamber; and in that means (5, 8) are provided for imparting to the fibers in the fiber suspension kinetic energy of such high value that the individual fibers will pass through the adhesive mist and move substantially rectilinearly into the forming chamber (9).

8. Apparatus acording to claim 7 having said means for imparting said kinetic energy to the fibers includes a fan (5) and an acceleration nozzle (8).

9. Apparatus according to claim 7 having means (33, 33') for continuously applying an air-permeable layer on each of the mutually facing surfaces of said band parts.

10. Apparatus according to claim 8 having means (33, 33') for continuously applying an air-permeable layer on each of the mutually facing surfaces of said band parts.

* * * * *